US008021170B2

(12) United States Patent
Pan

(10) Patent No.: US 8,021,170 B2
(45) Date of Patent: Sep. 20, 2011

(54) ELECTRICAL CONNECTOR HAVING IMPROVED TERMINAL MODULE

(75) Inventor: Feng Pan, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 274 days.

(21) Appl. No.: 12/381,029

(22) Filed: Mar. 5, 2009

(65) Prior Publication Data

US 2009/0233471 A1 Sep. 17, 2009

(30) Foreign Application Priority Data

Mar. 5, 2008 (CN) ..... 2008 2 0032485 U

(51) Int. Cl.
*H01R 13/648* (2006.01)

(52) U.S. Cl. ..... 439/108; 439/607.06

(58) Field of Classification Search ..... 439/607.05–607.07, 108

See application file for complete search history.

(56) References Cited

U.S. PATENT DOCUMENTS

| | | | | |
|---|---|---|---|---|
| 5,224,867 | A * | 7/1993 | Ohtsuki et al. | 439/108 |
| 6,174,202 | B1 * | 1/2001 | Mitra | 439/607.09 |
| 6,293,827 | B1 * | 9/2001 | Stokoe | 439/607.07 |
| 6,347,962 | B1 * | 2/2002 | Kline | 439/607.07 |
| 6,743,057 | B2 * | 6/2004 | Davis et al. | 439/701 |
| 6,872,085 | B1 | 3/2005 | Cohen et al. | |
| 7,416,447 | B1 * | 8/2008 | Chen | 439/607.05 |

* cited by examiner

*Primary Examiner* — Xuong Chung Trans

(74) *Attorney, Agent, or Firm* — Wei Te Chung; Andrew C. Cheng; Ming Chieh Chang

(57) ABSTRACT

An electrical connector has an insulative housing (10) having a front face (14) and a rear face (12), a number of terminal modules (20) mounted to the insulative housing in a back-to-front direction. The terminal module has a base (20), a number of terminals (23) and grounding contacts (25) exposed from the base and located adjacent to one another. Each terminal has a mounting end (233) and a mating end (231). The grounding contact has a tail (253) and a contacting portion (251). The mounting ends of the terminals are positioned along a back-to-front mounting face. The mating ends of the terminals are located in a second plane parallel to said back-to-front mounting face. The contacting portions of the grounding contacts are lied in a third plane parallel to the second plane.

16 Claims, 5 Drawing Sheets

ELECTRICAL CONNECTOR HAVING IMPROVED TERMINAL MODULE

BACKGROUND OF THE INVENTION

1. Field of the Invention

The present invention relates to an electrical connector, and more particularly to an electrical connector having a plurality of improved terminal modules.

2. Description of the Prior Art

U.S. Pat. No. 6,872,085, issued to Cohen on Mar. 29, 2005 disclosed an electrical connector assembly having a first electrical connector mateable to a second electrical connector. In one embodiment, the first electrical connector includes a plurality of wafers, with each wafer having an insulative housing, a plurality of signal conductors and a shield plate. A portion of the shield plate is exposed so that a conductive member can electrically connect the shield plates of the wafers at the exposed portion of the shield plate. In one embodiment, the second electrical connector includes an insulative housing, and a plurality of signal conductors and ground conductors in a plurality of rows. Each row corresponds to a wafer of the first electrical connector. Each signal conductor has a contact tail and each ground conductors has two contact tails. The signal conductors and the ground conductors are positioned adjacent to one another so that for each signal conductor contact tail, there are ground conductor contact tails adjacent either side of the signal conductor contact tail. During assembly, it is believed the configuration suggested by Cohen '085 needs more space therefore increasing the manufacturing cost.

Hence, an improved electrical connector is needed to solve the above problem.

BRIEF SUMMARY OF THE INVENTION

One object of the present invention is to provide an electrical connector comprising a terminal module having a plurality of terminals and grounding contacts are easily mounted to a base.

The present invention provides an electrical connector comprising an electrical connector configured by a plurality of wafers and each including, an insulative housing defining a mating interface, and a mounting interface, a plurality of differential pair contacts integral with the insulative housing and a grounding shield. The differential pair contact has a mating ends extending out of the mating interface, and a mounting end extending out of the mounting interface. The grounding shield attached to the housing and located adjacent to the plurality of differential pair contacts and including a plurality of grounding contacts disposed adjacent to the mating ends of the differential pair contacts, and tail portion each interposed within two adjacent pairs of differential pair contacts.

Advantages of the present invention are to provide a plurality of terminals and grounding contacts which are located one next to another to expose from one base. Therefore, It is easy to assembly of the terminal module and save a lot of cost of the manufacture.

Other objects, advantages and novel features of the invention will become more apparent from the following detailed description of the present embodiments when taken in conjunction with the accompanying drawings.

DETAILED DESCRIPTION OF THE INVENTION

Figure 1:
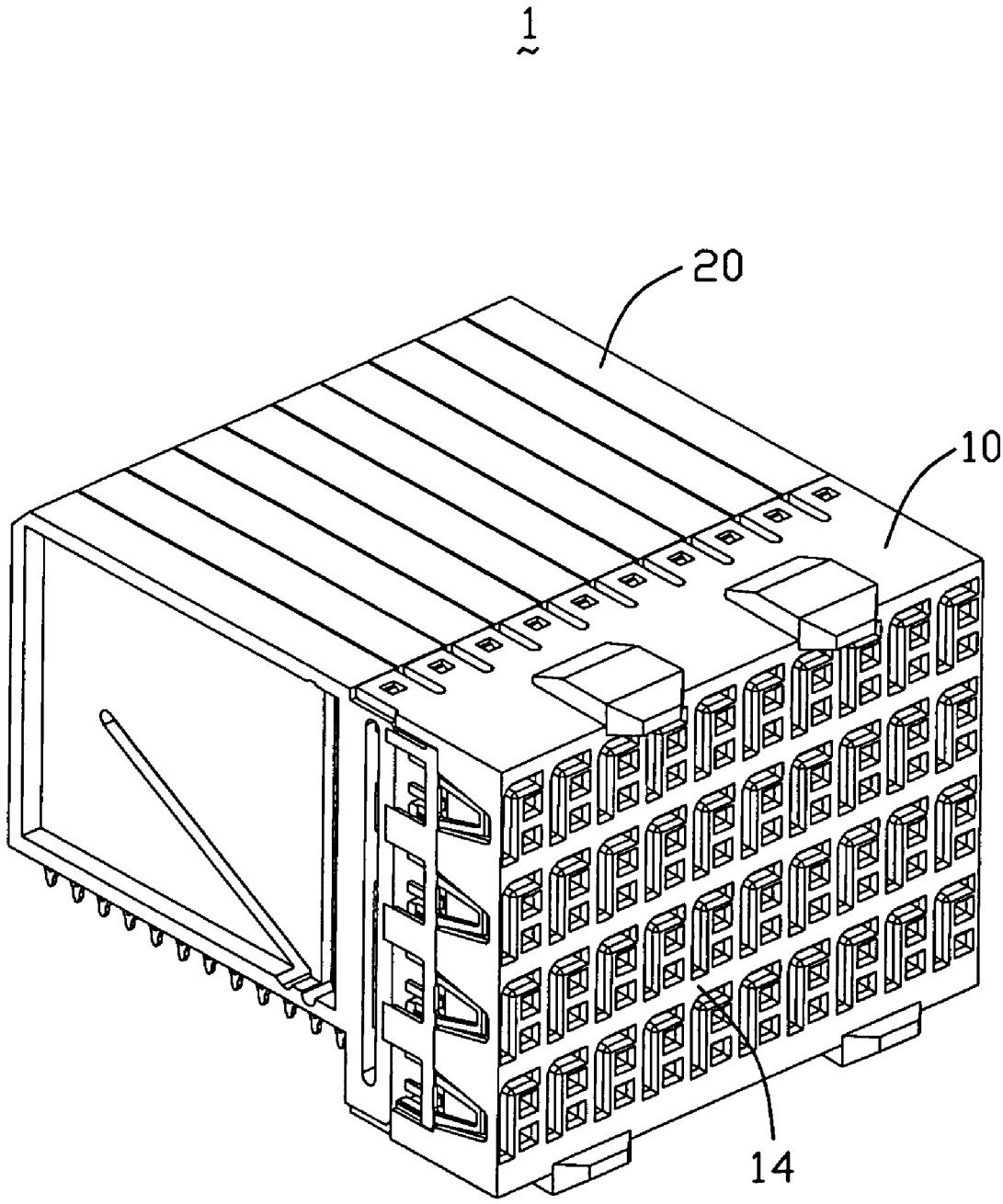
FIG. 1 is an assembled perspective view of an electrical connector, in accordance with the present invention.

Reference will now be made to the drawing figures to describe the present invention in detail. Referring to FIGS. 1-4, an electrical connector 1 for mounting on a printed circuit board (not shown) comprises an insulative housing 10 and a plurality of terminal modules 20 mounted to the insluative housing 10.

Figure 2:
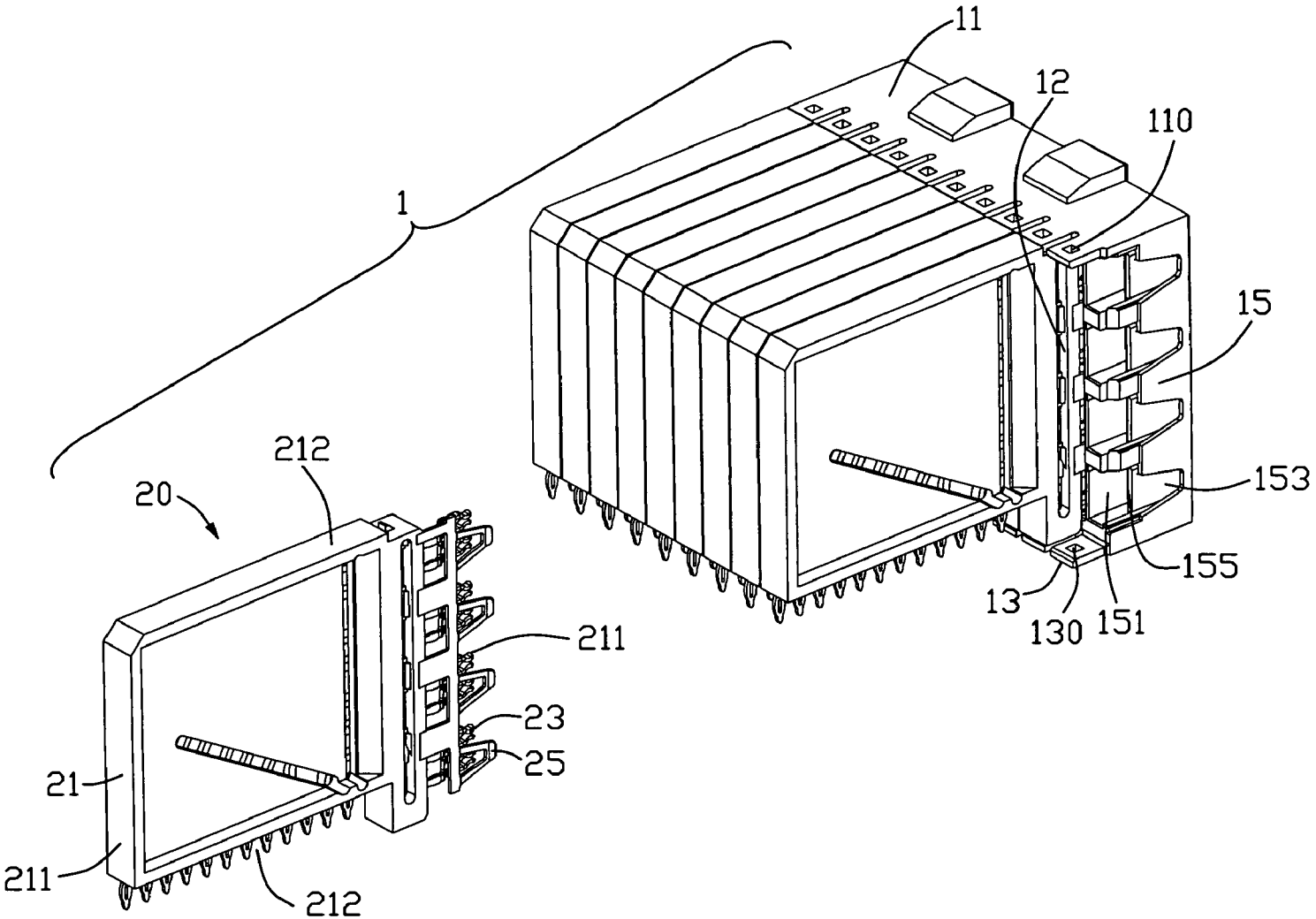
FIG. 2 is a partially exploded view of the electrical connector as shown in FIG. 1.
Figure 3:
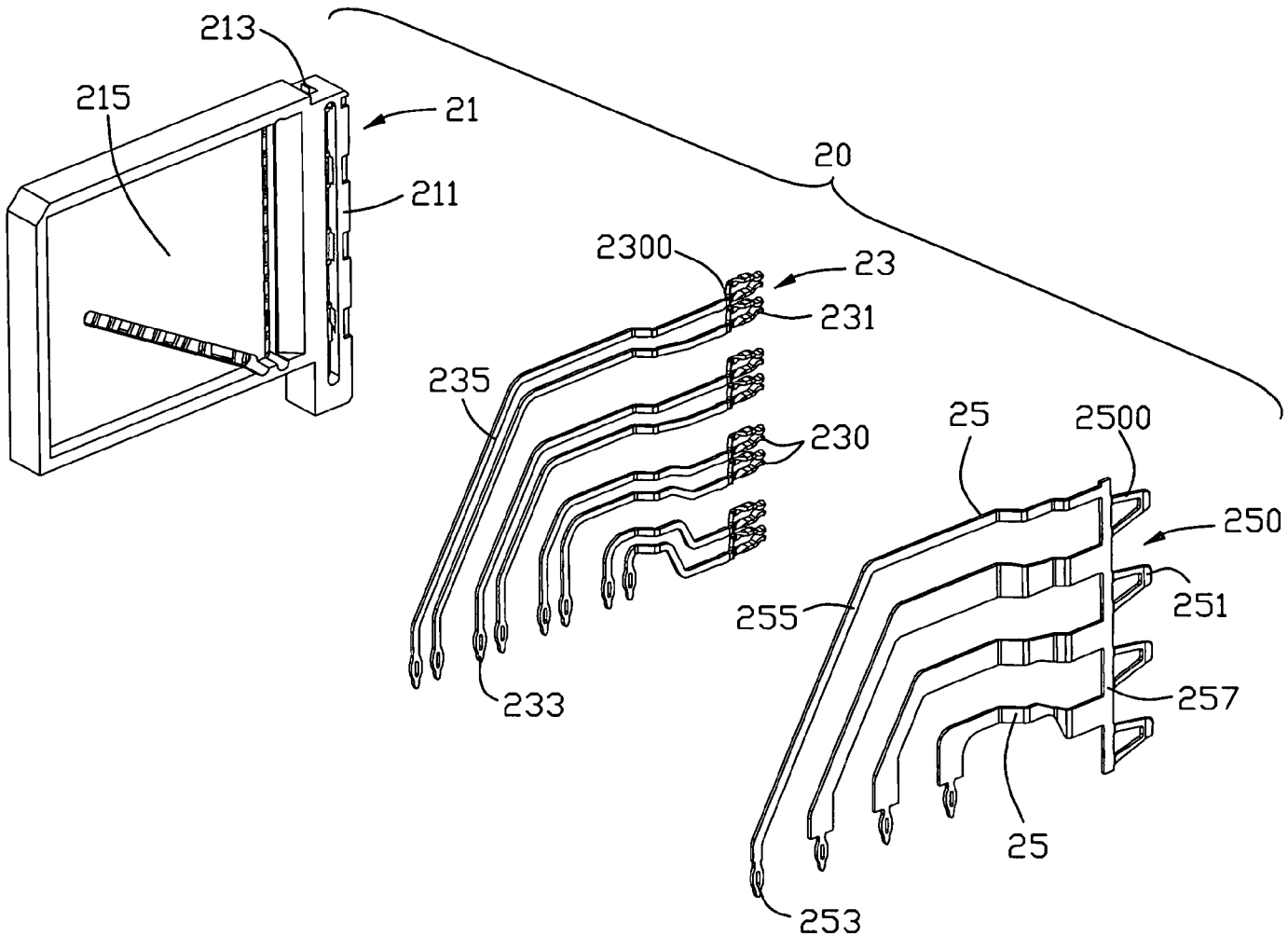
FIG. 3 is an exploded view of a terminal module.

Referring to FIGS. 1 and 2, the insulative housing 10 has a top face 11, a bottom face 13, a front face 14, a rear face 12, a pair of side faces 15, four groups of first and second passages 151, 153 which are staggeredly arranged and extend through the rear face 12 and front face 14. The four rows of the first and second passages 151, 153 are profiled one above the other.

Referring to FIGS. 1-4, the terminal module 20 comprises a base 21, a plurality of terminals 23 and grounding contacts 25 exposed from the base 21 and located adjacent to one another. The base 21 is of rectangular configuration and has a pair of first side walls 211 and a pair of second side walls 212. The first side wall 211 has a protrusion 213 formed thereon for locking with a recess 110 defined on an edge portion of the top face 11 of the base 10. Each terminal 23 has a mounting end 233 exposed downwardly from the second side wall 212 of the base 21 and a mating end 231 projecting into the first passage 151. The terminals 23 are arranged in different pairs. Each pair of terminals 23 have a transition region 2300 bent out of intermediate portions 235 of the terminals 23. Each grounding contacts 25 has a first tail 253 for connecting with the printed circuit board and a second contacting portion 251 which is of V-shape and received in the second passage 153. The mounting ends 233 of the terminals 23 and the first tails 253 of the grounding contacts 25 are positioned in a same column and along a back-to-front mounting face. The mating ends 231 and the second contacting portions 251 are located in two different rows. The mating ends 231 of the terminals 23 are positioned in a second plane parallel to the back-to-front mounting face. The second contacting portions 251 of the grounding contacts 25 are lied in a third plane parallel to the second plane.

The plurality of the grounding contacts 25 are punched by a metal shield 250 and have an intermediate bar 257 and a plurality of connecting portions 255 extending from the intermediate bar 257. The first tails 253 are bent from the connecting portion 255 at an angle that allows first tails 253 to be aligned along the column with the mounting ends 233 of the terminals 23 for connecting with the printed circuit board. The second contacting portions 251 project forwardly from the intermediate bar 257. The pair of the terminals 23 and the grounding contacts 25, respectively, are located one next to the other. The distance between the successive columns of the terminal groups 230 and the grounding contacts 25 is equal. The shield 250 has a transition region 2500 in which shield 250 is bent out of the connecting portion 255 and in parallel to the transition region 2300 of the terminal 23.

Figure 4:
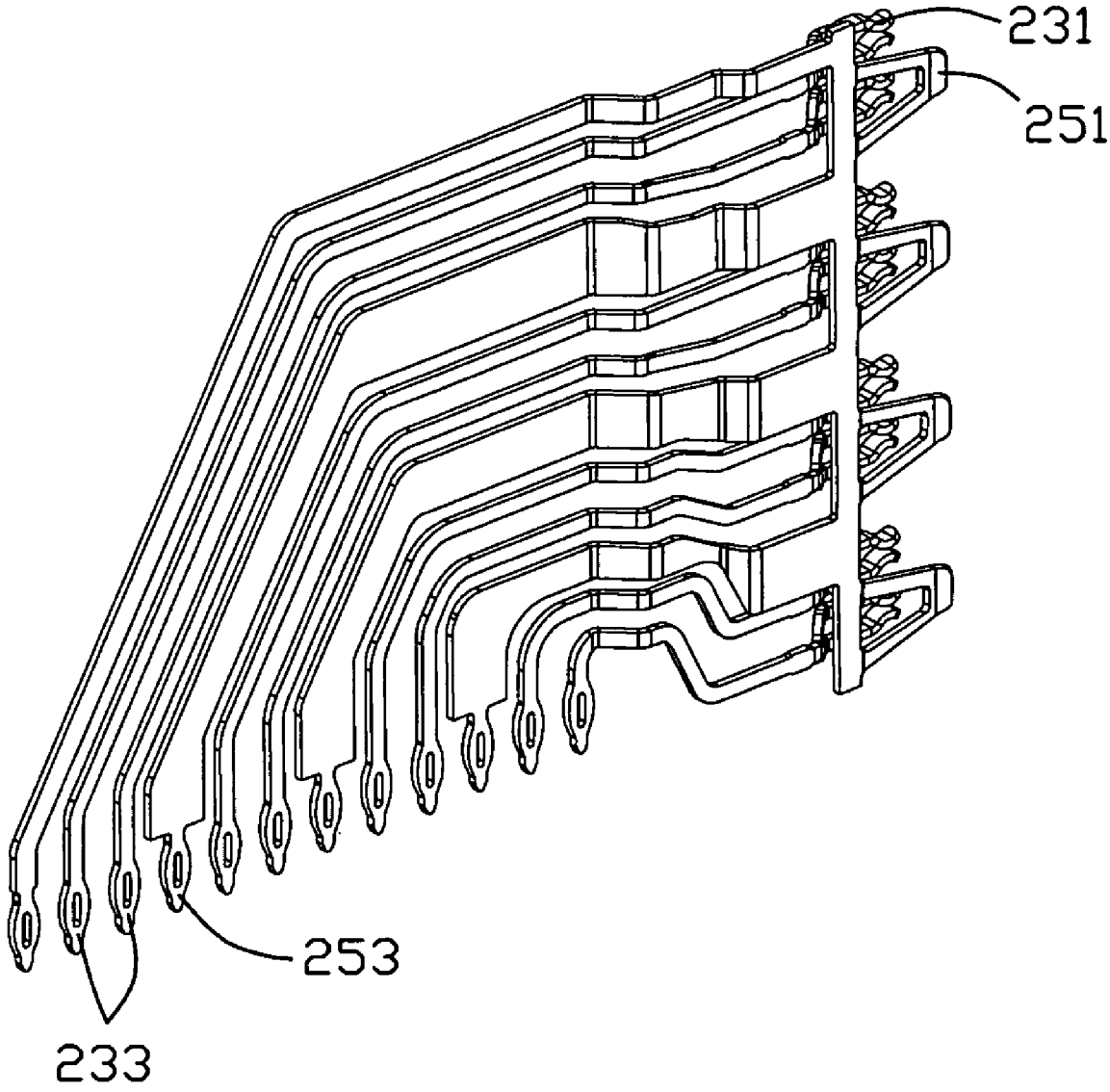
FIG. 4 is a perspective view of a plurality of terminals and grounding contacts as shown in FIG. 2.
Figure 5:
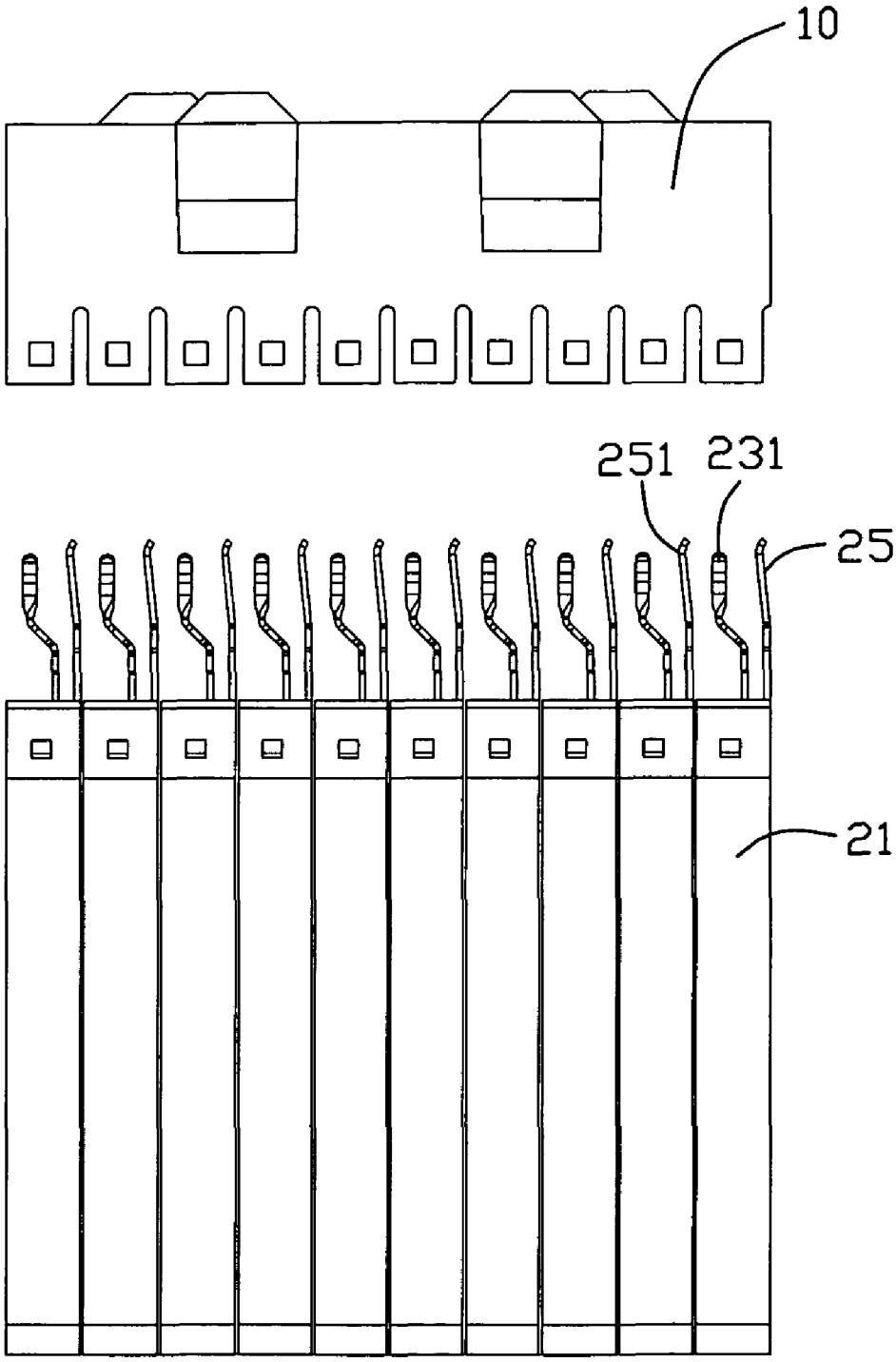
FIG. 5 is a top view of a plurality of terminals and grounding contacts as shown in FIG. 2.

Referring to FIGS. 4 and 5, in assembling of the electrical connector 100, firstly, the terminals 23 and the grounding contacts 25 are mounted in the base 21 during injecting moulding. Secondly, terminal modules 20 are inserted in the insulative housing 10 in a back-to-front direction, with the mating ends 231 of the terminals 23 received in the first passage 151 of the insulative housing and the second contacting portions 251 of the contacts 25 received in the second passages 153. The protrusion 213 of the first side wall 211 is locked with the recess 110 of the base 10.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an electrical connector configured by a plurality of wafers and each including:

an insulative housing defining a mating interface, and a mounting interface;

a plurality of differential pair contacts integral with the insulative housing having a mating end extending out of the mating interface, and a mounting end extending out of the mounting interface, and an intermediate portion between the mating end and the mounting end;

a grounding shield attached to the housing and located adjacent to the plurality of differential pair contacts and including a plurality of grounding contacts disposed adjacent to the mating ends of the differential pair contacts, and tail portion each interposed within two adjacent pairs of differential pair contacts, said grounding shield having an intermediate bar, a plurality of connecting portions bent from the intermediate bar, and a plurality of slots each between two adjacent connecting portions for accommodating said intermediate portions of each differential pair contacts, each connecting portion of the grounding shield being interposed within two adjacent pairs of differential pair contacts.

2. The electrical connector as claimed in claim 1, wherein said grounding contacts each having a contacting portion integral with the insulative housing, said mounting ends of the terminals and the tails of the grounding contacts are disposed coplanar and positioned in a same column, the mating ends and the contacting portions located in two different columns.

3. The electrical connector as claimed in claim 2, wherein said contacting portions extend forwardly from the intermediate bar.

4. The electrical connector as claimed in claim 3, wherein said tails extend from the connecting portions at an angle to be aligned along the column with the mounting ends of the terminals.

5. The electrical connector as claimed in claim 1, wherein a pair of the terminals are formed as a terminal group, and said each pair of the terminals and the grounding contacts, respectively, are located one next to the other.

6. The electrical connector as claimed in claim 1, wherein a distance between the successive columns of the terminal groups and the grounding contacts is equal.

7. The electrical connector as claimed in claim 2, wherein said contacting portion of the grounding contact has a V-shape.

8. The electrical connector as claimed in claim 2, wherein said base of terminal module is of rectangular configuration and has a pair of opposite side walls.

9. The electrical connector as claimed in claim 8, said mounting ends of the terminals and the tails of the grounding contacts extend downwardly and outwardly from one of the side walls, and the mating end of the terminal and the contacting portion of the grounding contact extend from the other side wall.

10. The electrical connector as claimed in claim 8, wherein side wall has a protrusion formed thereon for locking with a recess defined on an edge portion of the base.

11. The electrical connector as claimed in claim 2, wherein said insulative housing defines a plurality of first and second passages for receiving the mating ends of the terminals and the contacting portions of the grounding contacts.

12. The electrical connector as claimed in claim 1, wherein said insulative housing comprises a front face and a rear face, said mounting ends of the terminals and the tails of the grounding contacts are positioned along a back-to-front mounting face, the mating ends of the terminals are located in a second plane parallel to said back-to-front mounting face, and the second contacting portions of the grounding contacts lie in a third plane parallel to the second plane.

13. An electrical connector for use with a complementary connector and a printed circuit board, comprising:

a plurality of terminal module units side by side arranged with one another along a transverse direction;

a plurality of discrete terminals disposed in each terminal module unit, each of said terminals defining a mating section for mating with the complementary connector and a mounting section for mounting to the printed circuit board;

a unitary metallic shielding disposed on one side of the terminal module unit, said shielding defining a mating region for mating with the complementary connector and a mounting region for mounting to the printed circuit board; wherein the mating region and the mating sections are located in different first and second vertical plane while the mounting sections and the mounting region are located in a same third vertical plane under condition of said first, second and third vertical planes being perpendicular to said transverse direction.

14. The electrical connector as claimed in claim 13, wherein said first plane, and said third plane are close to each other while both being space from the second plane with a distance.

15. The electrical connector as claimed in claim 13, wherein each terminal has an intermediate portion between the mating section and the mounting section, and the metallic shielding includes a connecting portion between the mating region and the mounting region, said intermediate portions of the terminals and the connecting portion of the metallic shielding being partially located in said same third vertical plane.

16. The electrical connector as claimed in claim 13, wherein portions of the terminals located right above the corresponding mounting sections and portions of the shielding located right above the corresponding mounting region, are all located in the third vertical plane.

* * * * *